United States Patent [19]

Berney

[11] 4,266,288

[45] May 5, 1981

[54] ELECTRONIC TIMEPIECE

[75] Inventor: Jean-Claude Berney, Epalinges, Switzerland

[73] Assignee: Jean-Claude Berney SA, Epalinges, Switzerland

[21] Appl. No.: 945,384

[22] Filed: Sep. 25, 1978

[30] Foreign Application Priority Data

Sep. 27, 1977 [CH] Switzerland ..... 011765/77

[51] Int. Cl.[3] ..... G04B 19/24; G04C 17/00; G04B 19/00; G04B 27/00

[52] U.S. Cl. ..... 368/28; 368/69; 368/76; 368/185; 368/228

[58] Field of Search ..... 58/23 R, 5, 85.5, 152 B, 58/16, 16 D, 16.5, 19 B, 19 A, 19 R, 34, 33, 35 R, 58, 4 R, 50 R, 28 R; 368/28, 69, 76–81, 228, 187

[56] References Cited

U.S. PATENT DOCUMENTS

| | | | |
|---|---|---|---|
| 3,802,622 | 4/1974 | Nishimura et al. | 235/151.11 |
| 3,934,185 | 1/1976 | Schoonover et al. | 318/565 |
| 3,943,696 | 3/1976 | Portmann | 58/23 R |
| 3,998,043 | 12/1976 | Tamaru et al. | 58/23 R |

*Primary Examiner*—J. V. Truhe
*Assistant Examiner*—John B. Conklin
*Attorney, Agent, or Firm*—Wender, Murase & White

[57] ABSTRACT

An electronic timepiece having a minute hand and an hour hand which are controlled by a control circuit of the timepiece to display and to program, in addition to their own parameters, other parameters such as date, month, second, alarm time, or other, non time-related, parameters, which can be selected by push-button or pull-switch control means.

7 Claims, 4 Drawing Figures

ELECTRONIC TIMEPIECE

BACKGROUND OF THE INVENTION

The object of the present invention is an electronic timepiece comprising at least one stepping motor driving, via a gear train, minute and hour hands, control means, a quartz resonator and an integrated circuit grouping amongst others a control circuit, a driving pulse former, minute and hour reference counters and at least counting and memorization circuits for the time information of the hour, minute and second.

As shown in applicant's United States patent application, Ser. No. 917,535, one of the hands, for example the seconds hand, may be used in an analog display electronic watch of the hands, for example that of the second, to display and program an auxiliary function such as an electronic trimmer.

The object of the present invention is to construct a timepiece only comprising hour and minute hands which permits one, on command, to display and to program time functions which are different from those to which they are initially intended, for example, the date, the month, the second, an alarm hour, or other parameters not having any time-related functions.

SUMMARY OF THE INVENTION

According to the present invention there is provided an electronic timepiece comprising at least one stepping motor driving, via a gear train, hour and minute hands, control means, a quartz crystal resonator and an integrated circuit including amongst others a control circuit, a driving pulse former, minute and hour reference counters respectively synchronous with the minute and hour hands, and at least counting and memorizing circuits for the time information of the hour, minute and second, switch means associated with the control means and selection means and comparison means for the information delivered, on the one hand, by the counting and memorizing circuits and, on the other hand, by the reference counters, the said selection means being governed by the said control means and the result of the said comparison being used for setting, via the control circuit and the pulse former, the minute and hour hands in such a manner that they display functions other than the minutes and hours, the said control means permitting, via associated switch means, the correction and programming of said displayed functions.

BRIEF DESCRIPTION OF THE DRAWINGS

The invention will be described further, by way of example, with reference to the accompanying drawings in which.

DESCRIPTION OF THE PREFERRED EMBODIMENT

Figure 1:
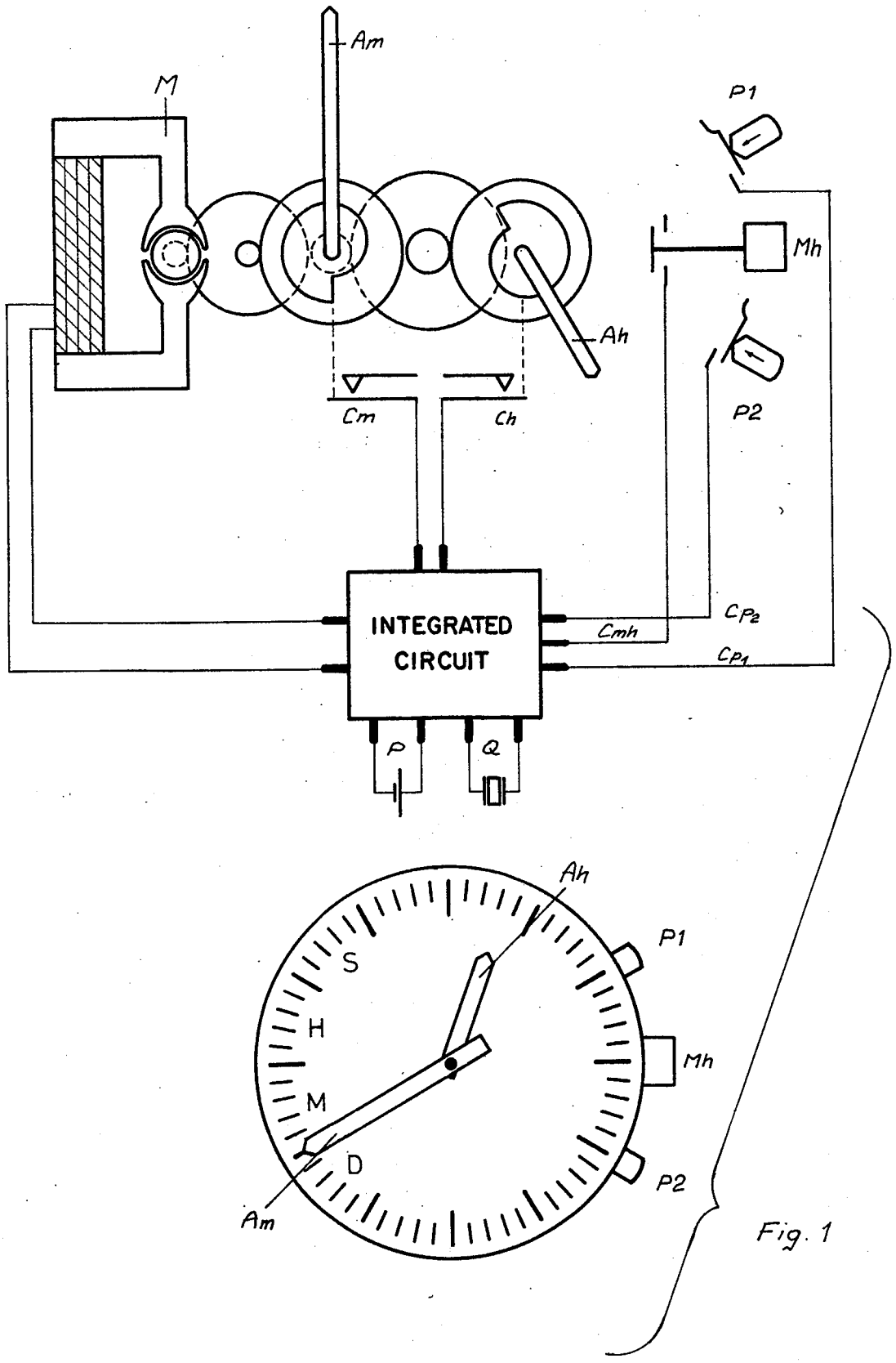
FIG. 1 is a diagrammatic representation of a preferred embodiment of a timepiece according to the invention.

In accordance with FIG. 1, a stepping motor M drives minute Am and hour Ah hands via a gear train. The gear train likewise drives a first contact Cm synchronously with the minute hand, and a second contact Ch synchronously with the hour hand. The control means are represented by the push-buttons P1 and P2 and a two-position pull-out switch MH, respectively operating contacts $C_{p1}$, $C_{p2}$, and $C_{mh}$. These contacts, and similarly, contacts Cm and Ch, the coil of the motor M, the quartz crystal Q and the electric supply source P, are connected to the integrated circuit CI.

In the case described, the minute hand is displaced by 1/60 of a turn by each step of the stepping motor which corresponds to one division of the dial. This dial carries indexes D (date), M (month), H (hours) and S (seconds) situated at the dial positions corresponding to the minutes 37, 42, 47 and 52, respectively.

Figure 2:
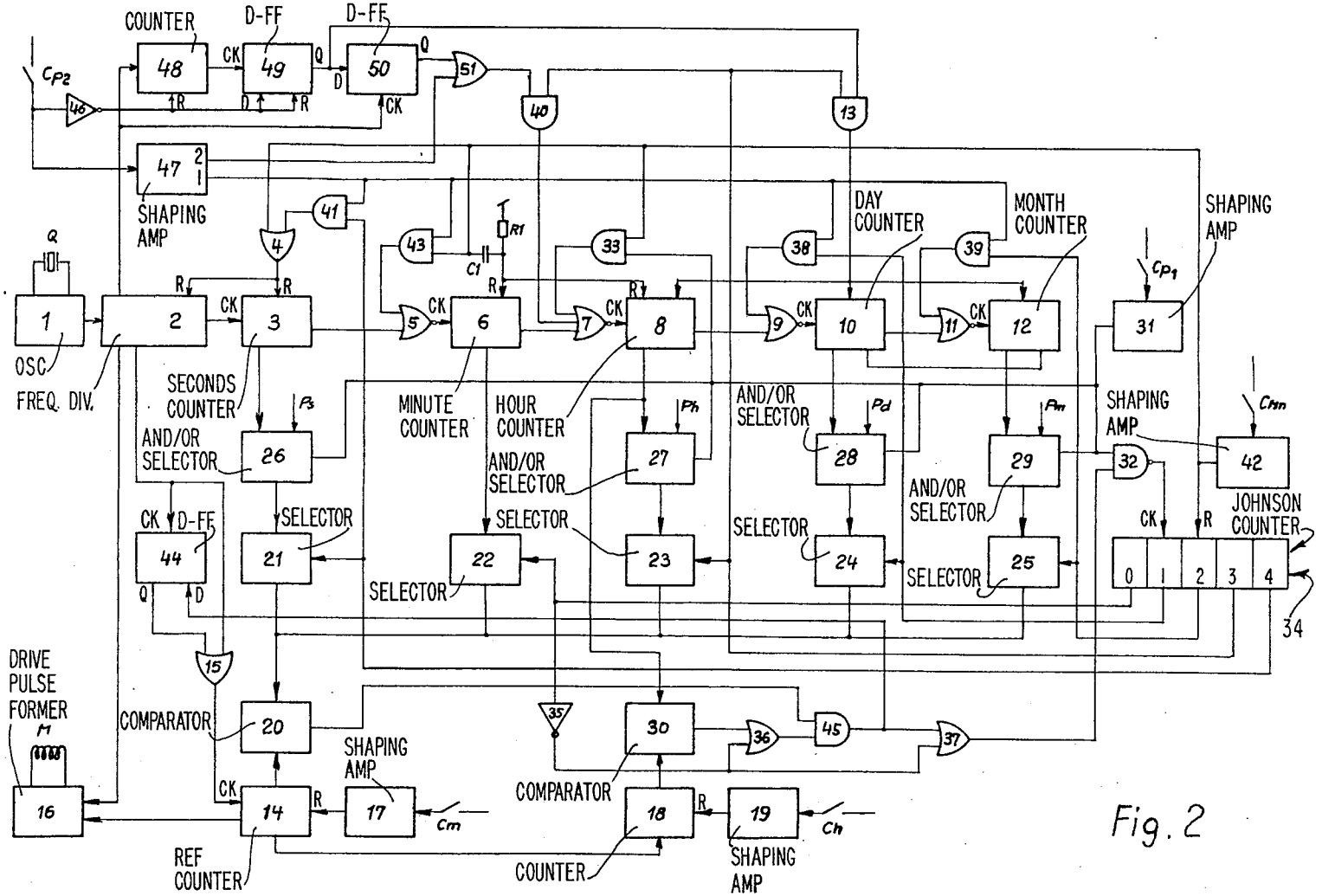
FIG. 2 is a block diagram of an embodiment of a circuit of a timepiece according to the invention.

In FIG. 2 the contacts Cm, Ch, $C_{p1}$, $C_{p2}$ and $C_{mh}$, as well as the quartz crystal Q and the coil of the motor M are shown, but the battery P is not shown.

An oscillator 1 is connected to an input of a frequency divider 2, which provides a 1 Hz signal at an input of a seconds time counter 3. This counter 3 comprises a counter by six followed by a counter by five then by a counter by two and its reset input is connected to the output of an OR gate 4, also connected to a reset input of the divider 2, only the 1 Hz output of this divider 2 being affected by this reset.

The counter 3 delivers short output pulses to an input of a NOR gate 5, the output of which is connected to the input of a minute time counter 6. This counter 6 is composed similarly to the counter 3. The output of counter 6 is connected to an input of a NOR gate 7, the output of which is connected to the input of an hour time counter 8. This counter 8 is composed of a counter by six followed by a counter by two and then by a second counter by two. It delivers short pulses to the input of a NOR gate 9, the output of which is connected to the input of a date time counter 10. The output of this counter 10 is connected to an input of a NOR gate 11, the output of which is connected to the input of a month time counter 12, which is connected to the counter 10 to form a perpetual calendar. The counter 10 comprises a counter by six followed by a counter by five then by a counter by two, these counters being arranged to count from 1 to 31, 1 to 30 or 1 to 28 in accordance with the month. The counter 12 comprises a counter by six followed by a counter by two. The counters 6, 8, 10 and 12 are thus compatible, i.e. they all deliver the same binary information for the same state. The counters 8, 10 and 12 are of the updown type. Their "down" input is connected to the output of an AND gate 13. The circuit also comprises a reference counter 14, the clock input of which is connected to the output of an OR gate 15. This counter 14 is composed similarly to the counter 6. One of its outputs is connected to a driving pulse former 16, which delivers pulses to the coil M of the motor each time the counter 14 advances one step. The reset input of this counter 14 is connected to the output of a shaping amplifier 17 of the contact Cm. The pulse former 16 is connected to the output of the divider 2, which determines the duration of the driving pulses. The output of the counter 14 is connected to the input of a counter 18 comprising a counter by six followed by a counter by two and the reset input of this counter 18 is connected to a shaping amplifier 19 of the contact Ch.

The circuit additionally comprises a first equality comparator 20 connected to the binary outputs of the counter 14 by a plurality of connections, schematically represented by a single connection. The comparator 20 is also connected by as many connections, to the outputs of three-state selectors 21, 22, 23, 24 and 25, which have as many inputs. The inputs of selector 21 are connected to the outputs of an AND/OR selection circuit 26, the inputs of which are connected to the binary outputs of the counter 3. The inputs of selector 22 are connected directly to the binary outputs of the counter 6, the inputs of selector 23 are connected to the outputs of an AND/OR circuit 27 the inputs of which are connected to the binary outputs of the counter 8. The inputs of selector 24 are connected to the outputs of an AND-/OR circuit 28 the inputs of which are connected to the binary outputs of the counter 10, and the inputs of selector 25 are connected to the outputs of an AND/OR circuit 29, the inputs of which are connected to the binary outputs of the counter 12. All of these counters deliver seven bits, even if certain of these are fixed, so as to always present two sets of information of the same length to the inputs of the comparator 20. The second inputs of the AND/OR circuits 26, 27, 28 and 29 are each connected to a fixed information of seven bits, respectively Pd, Pm, Ph and Ps, corresponding to the states 37, 42, 47 and 52 of the counter 14. The first four bits of the information delivered by the counter 8 are applied to the inputs of a second equality comparator 30 the second inputs of which are connected to the binary outputs of the counter 18. The control inputs of the AND/OR circuits 26, 27, 28 and 29 are connected to the output of a shaping amplifier 31 of the contact $C_{p1}$, which is also connected to the first input of a NAND gate 32, and to the first input of an AND gate 33, the output of which is connected to a second input of the gate 7. The output of the gate 32 is connected to the clock input of a counter by five 34. This counter 34 is of the JOHNSON type and has five decoded outputs corresponding to the states 0, 1, 2, 3 and 4 of the counter. The "0" output is connected to the control input of the selector 22 and to the input of an inverter 35, the output of which is applied to the first inputs of two OR gates 36 and 37, the output of gate 37 being connected to the second input of the gate 32. The "1" output of the counter 34 is connected to the control input of the selector 24 and to the first input of an AND gate 38. The "2" output of the counter 34 is connected to the control input of the selector 25 and to the first input of an AND gate 39. The "3" output of the counter 34 is connected to the input of the selector 23 and to the inputs of gates 13 and 40, gate 40 being an AND gate. The "4" of the counter 34 is connected to the control input of the selector 21 and to the first input of an AND gate 41. The reset input of the counter 34 is connected to the output of a shaping amplifier 42 of the contact $C_{mh}$ and also to the second inputs of the gates 4 and 33 and the first input of an AND gate 43. This output is also connected to the capacitor $C_1$, which delivers a pulse on the resistance $R_1$ and to the reset inputs of the counters 6 and 8.

The divider 2 delivers a medium frequency signal, in our case 128 Hz, to the clock input of a D-type flip-flop 44 and to the first input of the gate 15, the second input of which is connected to the Q output of FF 44, the D input of this FF 44 being connected to the input of the gate 37 and to the output of an AND gate 45. The first input of this gate 45 is connected to the equality output of the comparator 20, whilst its second input is connected to the output of the gate 36, the second input of which is connected to the equality output of the comparator 30. The contact $C_{p2}$ is connected to the inputs of an inverter 46 and of a shaping amplifier 47. The latter is made on such a manner as to deliver, on its first output, pulses corresponding to the positive-going edge of its input signal and on its second output, pulses corresponding to the negative-going edge of its input signal. The first output is connected to the second input of the gate 41, the output of which is connected to the second input of the gate 4, to the second input of the gate 43, the output of which is connected to the second input of the gate 5, to the second input of the gate 38, the output of which is connected to the second input of gate 9, and to the second input of the gate 39, the output of which is connected to the second input of the gate 11. The output of the inverter 46 is connected to the reset input of a counter 48 and to the D and reset inputs of a D-type flip-flop 49, the Q output of which is connected to the second input of the gate 13 and to the D input of a D-type flip-flop 50. This FF 50 receives on its clock input, as does the counter 48, a signal from the divider 2. An output of the counter 48 is connected to the clock input of the FF 49. The second output of the shaping amplifier 47 is connected to the first input of an OR gate 51 the second input of which is connected to the Q output of the FF 50 and the output of which is connected to the second input of the gate 40. The output of this gate 40 is connected to a third input of the gate 7.

The function is explained as follows:

The flip-flops change over on the positive-going edge and the counters on the negative-going edge of the clock-signal. The oscillator 1 delivers a precise frequency signal, for example, 32,768 Hz, to the input of the divider 2. This divider 2 delivers, in our example, signals of 256 Hz frequency to the input of the shaping circuit 16, 128 Hz to the input of the FF 44, 8 Hz to the input of the counter 48, and 1 Hz to the input of the second counter 3. The counter 3 delivers every minute one pulse to the input of the minute counter 6 via the gate 5. The counter 6 delivers every hour a pulse to the input of the hour counter 8, via the gate 7. Every day, the counter 8 delivers a pulse to the input of the date counter 10 via the gate 9. The counter 10 delivers every month a pulse to the input of the month counter 12, via the gate 11. These different circuits thus form a complete time counting chain, each counter delivering an information signal corresponding respectively to the second, minute, hour, date and month parameters.

The counter 14 delivers a signal to the shaping circuit 16 each time it progresses by one step, the said shaping circuit 16 then delivering a driving pulse of 1/256 of a second to the coil M of the motor. The motor advances by one step and and the minute hand by one division of the dial. The counter 14 is moreover reset to 0 by the contact Cm when the minute hand passes by 0. The counter 14 is thus synchronous with the minute hand. Its state represents the position of the minute hand on the dial. The counter 14 delivers a signal to the input of the counter by twelve 18 at each turn of the minute hand. This counter is moreover reset to 0 by the contact Ch when the hour hand passes by 0. The counter 18 is thus synchronous with the hour hand. Its state represents the position of the hour hand on the dial.

The contacts Cm and Ch permit the automatic synchronisation of the counters 14 and 18 to the minute and hour hands respectively. One or the other of these contacts could be omitted, the said synchronisation then having to be initially effected by the user by particular manipulations of the control means ($C_{p1}$, $C_{p2}$, $C_{mh}$). Thus we have, on the one hand, a chain of time counters and, on the other hand, minute and hour hands and two counters synchronous with these hands. One can display the contents of the counters by means of the hands. We will describe the following points: normal hour and minute display, display and correction of the date, display and correction of the month, display and correction of the hour (time zones), display and correction of the second and hour setting.

NORMAL HOUR AND MINUTE DISPLAY

We have shown that the minute hand occupies a position corresponding to the contents of the counter 14, and the hour hand a position corresponding to the contents of the counter 18. So that the watch displays the hour and the minute, it is necessary that:

$I_{14}=I_6$ and $I_{18}=I_8$; where $I_x$=information delivered by counter x. The information $I_{14}$ is connected to the comparator 20 and the information $I_{18}$ to the comparator 30. During normal working, the contacts $C_{mh}$, $C_{p1}$ and $C_{p2}$ are open, the outputs of the amplifiers 42, 31 and 47 are at 0 and the counter 34 is at 0, so that its output 0 is at state 1 and its outputs 1 to 4 are at state 0. The three-state selectors 21, 23, 24 and 25 are closed, whilst the selector 22 is open, transmitting the information $I_6$ of the minute counter 6 to the comparator 20. The output of this comparator 20 passes to 1 in the case of equality of the two sets of information present to its inputs, in this case when $I_{14}=I_6$.

The information $I_8$ of the hour counter 8 is permanently connected to the input of the comparator 30. The output of this comparator 30 passes to 1 in the case of equality, in this case when $I_{18}=I_8$. The output of the inverter 35 being at 0, the output of the gate 36 passes to 1 at the same time as the output of the comparator 30.

Thus the output of the gate 45 passes to 1 when the comparators 20 and 30 simultaneously deliver an equality signal, that is to say, in this case, when:

$$I_{14}=I_6 \text{ and } I_{18}=I_8$$

The output of the gate 45 being connected to the D input of the FF 44, the Q output of this one is at 1. The gate 15 is blocked and delivers a positive signal to the clock input of the counter 14, which remains blocked in its state. The minute and hour hands, respectively, indicate the contents of the minute counter 6 and the hour counter 8.

When $I_6 \neq I_{14}$ or $I_8 \neq I_{18}$, the output of the gate 45 passes to 0, as does the output of the FF 44, unblocking the gate 15. This then transmits to the clock input of the counter 14 the 128 Hz frequency signals present on its second input. The shaping circuit 16, delivers driving pulses of this frequency to the motor which thus advances by 128 steps per second. When the equality is re-established, the outputs of the gate 45 and of the FF 44 return to 1 and the gate 15 becomes blocked.

For example, when the minute counter 6 advances by one step, the equality disappears and the outputs of the gate 45 and of the FF 44 pass to 0, unblocking the gate 15 and allowing the clock signal to pass to the counter 14. At the first negative-going edge, this counter 14 advances by one step and the circuit 16 delivers one driving pulse to the motor which advances one step. The counter 14 has now caught up the counter 6 and the equality reappears. The output of the gate 45 and the output of the FF 44 returns to 1, again blocking the gate 15. The minute hand has progressed by one division. As the counter 6 progresses by one step per minute, the minute hand will progress by one step per minute.

Thus the hands are stable when those of the minutes indicate the contents of the minute counter and those of the hours the contents of the hour counter. If for any reason this is no longer the case, the minute hand catches up at the rate of 128 steps per second until it returns to a stable position. As the hour and minute hands pass through all the display positions in 12 turns of the minute hand, namely 60 times 12=720 motor steps, this catching up operation will last a maximum of 720/128=5.6 s.

One can of course use a faster or slower motor or even a bidirectional motor collaborating with counters 14 and 18 of the up-down type. The use of a bidirectional motor permits, under certain conditions, driving a date mechanism for the classical display of the date, the minute and hour hands always permitting the display of other parameters on command, in accordance with the invention. It is also possible to use two motors, one driving the minute hand and collaborating with the counter 14, and the other driving the hour hand and collaborating with the counter 18.

DISPLAY AND CORRECTION OF THE DATE

When P1 is pressed, the contact $C_{p1}$ is closed and the output of the amplifier 31 passes to 1. The AND/OR circuits 26, 27, 28 and 29 select, on their respective outputs, the fixed information Pd, Pm, Ph and Ps. The output of the gate 45 being at 1, the output of the gate 37 passes to 1. When P1 is pressed, the output of the gate 32 passes to 0 and the counter 34 passes to the state 1. Its output 0 passes to 0 and its output 1 to 1, which blocks the selector 22 and opens the selector 24. The information Pd appearing at the output of the AND/OR circuit 28 is transmitted to the input of the comparator 20 which delivers an equality signal when:

$$I_{14}=P_d$$

Simultaneously, the output of the inverter 35 passes to 1, blocking the output of the gate 36 at 1. Thus the output of the gate 45 no longer depends on the state of the output of the comparator 30, but solely, as stated above, from the output of the comparator 20. The state of the counter 18, that is to say the position of the hour hand, is unimportant.

$P_d$ corresponds to the state 37 of the counters. The minute hand thus moves, at high speed, to the position 37 in front of the index D (date) (see FIG. 1), in accordance with the process previously described. The minute hand then displays the name of the parameter which will next be displayed.

When the push-button $P_1$ is released, the output of the amplifier 31 returns to 0 and the output of the gate 32 to 1. The counter 34 remains at the state 1. The AND/OR gates 26, 27 28 and 29 select the information respectively delivered by the counters 3, 6, 8, 10 and 12. The information $I_{10}$ is transmitted from the output of the AND/OR circuit 28 to the input of the comparator 20 by the selector 24. The minute hand is displaced at high speed until the condition $$I_{14}=I_{10}$$

is reached. The minute hand is held then at the position corresponding to the value of the date, contained in the counter 10. Thus, by pressing $P_1$, there is firstly displayed the name of the parameter which will be displayed upon releasing $P_1$.

The output 1 of the counter 34 being at 1, the gate 38 is unblocked. By pressing $P_2$, pulses appear at the output of the amplifier 47 and are transmitted to the clock input of the counter 10 by the gates 38 and 9, making the state of this counter 10 progress by one step upon the pressing of $P_2$. It is thus possible, when the date is displayed, to correct the corresponding counter. The new state of the counter 10 is of course immediately visible on the dial, because the circuit maintains the condition $I_{14}=I_{10}$.

DISPLAY AND CORRECTION OF THE MONTH

By pressing $P_1$ once again, the output of the gate 32 returns to 0 and the counter 34 passes to 2. Its output 1 passes to 0 and its output 2 to 1. The selector 24 becomes blocked and the selector 25 becomes open, transmitting the output of the AND/OR circuit 29 to the input of the comparator 20. As long as $P_1$ is maintained pressed, this AND/OR circuit selects the information $P_m$ corresponding to the state 42 of the counters. The output of the gate 36 still being at 1, the output of the comparator 30 is unimportant, and the output of the gate 45 passes to 1 for the condition:

$$I_{14}=P_m=42$$

The minute hand moves at high speed to the position 42 in front of the index M (month), the position of the hour hand being unimportant.

When $P_1$ is released, the AND/OR circuit 29 selects the information $I_{12}$ delivered by the month counter 12. The minute hand is displaced at high speed until the condition $I_{14}=I_{12}$ is reached. The minute hand is then held in the position corresponding to the value of the month, contained in the counter 12. The output 2 of the counter 34 being at 1, the gate 39 is unblocked. The output pulses of the amplifier 47 are transmitted to the clock input of the counter 12, via gates 39 and 11. It is thus possible to correct the month counter 12 when the value of the month is displayed.

DISPLAY AND CORRECTION OF THE HOUR (TIME ZONES)

By pressing $P_1$ again, the output of the gate 32 passes again to 0 and the counter 34 passes to the state 3. Its output 2 passes to 0, blocking the selector 25 and unblocking the selector 23 thus transmitting information selected by the AND/OR circuit 27 to the input of the comparator 20. As long as $P_1$ is pressed, this AND/OR circuit selects the information $P_h$ corresponding to the state 47 of the counters. As the output of the gate 36 is still blocked at 1, the output of the gate 45 will pass to 1 for the condition: $I_{14}=P_h=47$.

The minute hand moves at high speed and stops in the position 47 in front of the index H (hour).

When $P_1$ is released, the AND/OR circuit 27 selects the information $I_8$ of the counter 8. The minute hand is displaced at high speed until the condition $I_{14}=I_8$ is attained and is held in a position corresponding to the value of the hours contained in the counter 8. By this operation, the hour display is thus transferred from the hour hand on to the minute hand, which permits a 24 hours display to indicate the AM and PM hours.

The output of the counter 34 being at 1, the gates 13 and 40 are unblocked. By pressing $P_2$, the output of the inverter 46 passes to 0, making free the resetting of the counter by sixteen 48 and of the FF 49. The 48 receives a clock signal of 8 Hz from the divider, and its output passes to 1 after $P_2$ has been pressed for two seconds without interruption, making the FF 49 to change over to 1, FF 50 changing over to $1\frac{1}{8}$ of a second later. If $P_2$ is released prior to two seconds (short pressure) the counter 48 is returned to 0 before the FF 49 and 50 have changed over to 1. One pulse is delivered on the second output of the amplifier 47, passes by the gates 51, 40 and 7 on the clock input of the counter 8 which advances by one step.

If $P_2$ is maintained for longer than two seconds (sustained pressure) the FF 49 passes to 1. The output of the gate 13 passes to 1 and switches the counters 8, 10 and 12 into a downcounting mode (backwards). At the end of $\frac{1}{8}$ of a second, the FF 50 in turn passes to 1. The outputs of the gates 51 and 40 pass to 1 and remain there. The output of the gate 7 passes to 0 and the counter 8 goes back one step. When $P_2$ is released, the FF 49 and the output of the gate 13 return to 0 likewise. The counters 8, 10 and 12 are again in the normal upcounting mode (forward). The output of the FF 50 being still at 1, the pulse delivered by the amplifier 47 has no effect. This FF 50 changes state again to 0 at the end of $\frac{1}{8}$ of a second.

It is thus possible to add hours by short pressures on $P_2$, or to subtract hours by pressure of more than two seconds on $P_2$, whilst the minute hand displays the hour. This permits correction of the time zones without affecting the second and minute counters, the values of the date and of the month remaining correct.

DISPLAY AND CORRECTION OF THE SECOND

By pressing $P_1$ again, the counter 34 passes to the state 4. Its output 3 passes to 0, blocking the selector 23, and its output 4 passes to 1, enabling the selector 21 to transmit the information present at the output of the AND/OR circuit 26 to the input of the comparator 20. As long as $P_1$ is pressed, this AND/OR circuit selects the information $P_s$ and gives the condition $I_{14}=P_s=52$.

The output of the gate 36 still being at 1, the position of the hour hand is unimportant. The minute hand moves at high speed to the position 52, in front of the index S (second).

When $P_1$ is released, the AND/OR circuit 26 selects information $I_3$ delivered by the seconds counter 3. The comparator 20 gives the condition: $I_{14}=I_3$.

The minute hand moves at high speed to the position corresponding to the value of the seconds contained in the counter 3. As this value changes each second, the minute hand then advances by one division each second.

The output 4 of the counter 34 being at 1, the gate 41 is unblocked. Upon pressing $P_2$, one pulse is transmitted to the output of the amplifier 47 by the gates 41 and 4 at the reset inputs of the divider 2 and of the counter 3. By effecting this operation on concordance with a precise minute time signal, errors of plus or minus 30 seconds may be automatically corrected.

One can thus correct the seconds during the display of this parameter.

By pressing $P_1$ again, the counter 34 returns to 0. The output of the gate 37 passes to 0 and blocks the gate 32, preventing the user from passing to the next position before the hour and minute hands have returned into positions corresponding respectively to the counters 8 and 6 (normal display).

In the case described, the user could forget to return his watch to normal display, which could give rise to errors in the reading of the time. A simple means of avoiding this is to use a delay circuit which automatically returns the counter 34 to 0 (normal display position) after a certain lapse of time.

HOUR SETTING

The position 3 of the counter 34 already permits the correction of the hours. One could thus provide a supplementary position for correcting the minutes. One could equally well provide a more classic reset by which one can simultaneously correct the hours and minutes. Thus, in the diagram of FIG. 2, the setting of the hour is effected by pulling the reset switch MH. The contact $C_{mh}$ closes and the output of the amplifier 42 passes to 1, maintaining the counter 34 at 0. Simultaneously, the capacitor $C_1$ delivers a pulse to the terminal of the resistance $R_1$, effecting the return to 0 of the minute counter 6 and hour counter 8. The output of the gate 4 is at 1, blocking at 0 the divider 2 and the second counter 3. The hands come rapidly to the position 0h00 (midnight). The gates 33 and 43 are unblocked. Upon pressing $P_1$, a clock signal is given to the counter 8 via the gates 33 and 7, making this counter progress by one step for each operation of $P_1$. The minute hand makes one turn at each pressure. Upon pressing $P_2$, the output of the amplifier 47 delivers clock pulses to the minute counter 6 by the gates 43 and 5, making the counter progress by one step for each pressure on $P_2$. When the desired time has been obtained (for the PM hours, first advance by 12 hours), MH is pressed at the time signal. The contact $C_{mh}$ opens and the reset of the counters 34 and 3, as well as the divider 2 disappears. The watch returns to normal display.

In the different cases described above, the desired values have always been displayed by means of the minute hand, the hours hand being unimportant. It is also possible to display values other than the hours by means of the hour hand by switching, by means of adequate selectors, the information at the input of the comparator 30. For example, one could display simultaneously the date with the minute hand and the month with the hour hand. The comparator 20 then gives the condition $I_{14}=I_{10}$ and the comparator 30 the condition $I_{18}=I_{12}$.

The output of the gate 45 passes to 1 when these two conditions are fulfilled simultaneously. Thus 12h 24 would signify the 24th day of the 12th month.

Likewise one could simultaneously display the name of the desired parameter by means of the hour hand and the value of this parameter by means of the minute hand. Thus during the display of the date, the comparator 20 would give the condition $I_{14}=I_{10}$ and the comparator 30 $I_{18}=Pd=37$, the output of the gate 45 passing to 1 when these two conditions are fulfilled simultaneously. The hour hand then comes practically in front of the index D (date) whilst the minute hand is held in the position corresponding to the value of the date.

One can visualize and program in a similar manner other time functions such as the day of the week, the phases of the moon, an alarm time, the contents of a counter chronograph etc., or other functions not depending on the time such as the position of an electronic trimmer, the output state of a detector for the end of life of a battery, the voltage of the battery, the bio-rhythm, the pulse or the temperature of the bearer of the watch etc., the value of these parameters appearing at the output of the counters, memories or auxiliary measuring circuits internal to the integrated circuit, the states of these outputs corresponding to predetermined positions of one or other of the minute or hour hands.

Figure 3:
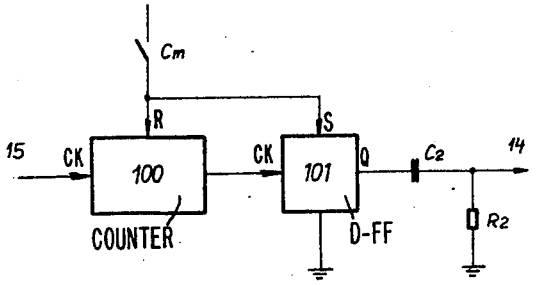
FIG. 3 is a block diagram of an identification circuit of the correct closing time of a contact for a timepiece according to the invention.

For example to display the alarm time, the comparator 20 gives the condition $I_{14}=I_{ma}$ and the comparator 30 the condition $I_{18}=I_{ha}$, the output of the gate 45 passing to 1 when these two conditions are fulfilled etc. Finally, the assembly of the motor, gear train and hand is a display device of two parameters not having any proper timing function, the choice of the parameters to be displayed and their value being determined solely by the electronic circuit. This circuit, whilst being relatively complex, only comprises well known functions, with the possible exception of the shaping amplifiers for the signals of the contacts Cm, Ch 17 and 19. These contacts are in fact driven at slow speed by cams and may bounce. It is thus desirable to provide an identification circuit for the correct contact time. FIG. 3 gives, by way of example, a circuit suitable for this use.

The counter by sixteen 100 receives, on its clock input, pulses synchronous with the driving pulses, coming, for example, from the output of the gate 15 of the circuit of FIG. 2. The output of this counter 100 is connected to the clock input of a D-type flip-flop 101 the D input of which is at 0. The reset input of the counter 100 and the set input of the FF 101 are connected to the contact Cm. The Q output of the FF 101 is connected by the capacitor $C_2$ to the resistance $R_2$ and to the reset input of the counter 14 of FIG. 2. When the contact Cm is closed, the output of the FF 101 is maintained at 1 and the counter 100 at 0. When the cam opens the contact, the counter is released. When the counter has counted sixteen motor steps, that is to say when the minute hand has described approximately a quarter of a turn, the FF 101 passes to 0. As soon as the minute hand passes 0, the contact Cm closes and returns the counter to 0. The FF 101 passes to 1 and delivers a reset pulse via the capacitor $C_2$ on the resistance $R_2$ and at the input of the counter 14. It can be seen that, in accordance with the shape of the cam in FIG. 1, the only zone where the contact is open during a quarter of a turn is the one which precedes the passage at 0, the first closure of Cm following this zone being precisely the passage of the minute hand at 0.

ALARM TIME

Figure 4:
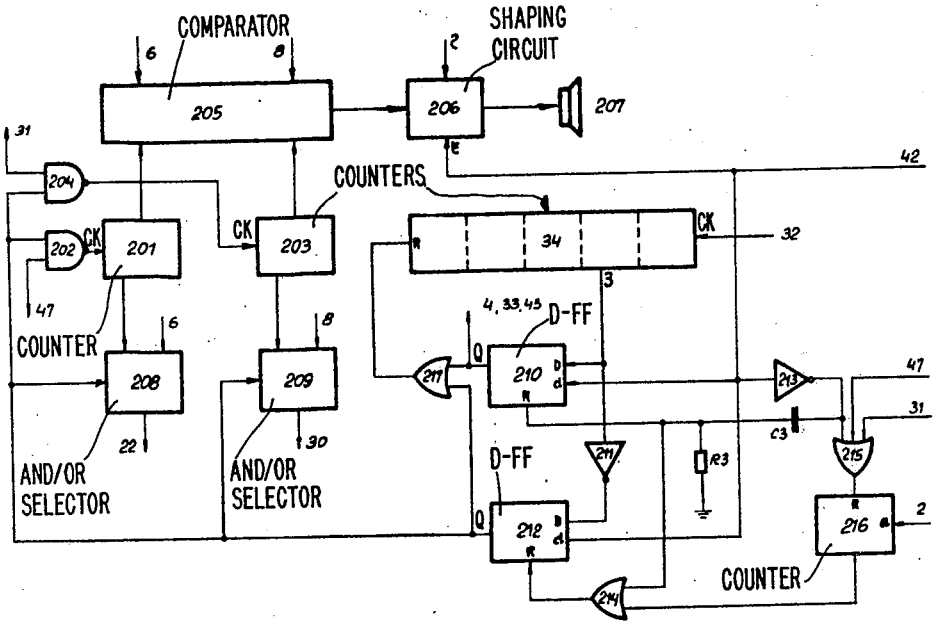
FIG. 4 is a block diagram of a circuit complementary to that of FIG. 2 for permitting display and programming of an alarm time according to the present invention.

FIG. 4 represents, by way of example, a complementary circuit to the one of FIG. 2 permitting the display and programming of an alarm time, a possibility which has been mentioned above.

It comprises a counter by sixty 201, the clock input of which is connected to the output of a NAND gate 202, and a counter by twelve 203, the clock input of which is connected to the output of the NAND gate 204. These two counters deliver information corresponding to their states to an equality comparator 205, receiving also the information delivered by the counters 6 and 8 of FIG. 2. The output of this comparator is connected to a shaping circuit 206 having an enable input connected to the output of the amplifier 42 of FIG. 2 and an output connected to a buzzer 207. This shaping circuit 206 is arranged to deliver acoustic frequency signals to the buzzer when its two inputs are at 1. In principle, the shaping circuit 206 is also connected to the output of the divider 2 which determine the frequency of these signals, or even a modulation sequence. The information delivered by the counters 201 and 203 are applied likewise to the inputs of AND/OR selection gates 208 and 209, the first being interposed between the output of the counter 6 and the input of the three-state selector 22 of FIG. 2, the second between the output of the counter 8 and the input of the comparator 30 of FIG. 2. The counter 34 of FIG. 2 still has its clock input connected to the output of the gate 32. Its output "3" is connected to the D input of a D-type FF 210 and to the input of an inverter 211, the output of which is connected to the D input of a D-type FF 212. The output of the amplifier 42 of FIG. 2 is connected to the clock inputs of FF 210 and 212, as is the input of an inverter 213. The output of this inverter 213 is derived by a capacitor $C_3$ and a resistance $R_3$ to create pulses. These pulses are applied to the reset input of the FF 210 and to the first input of an OR gate 214 the output of which is connected to the reset input of the FF 212. The output of the inverter 213 is applied, as well as to the outputs of the amplifiers 31 and 47 of FIG. 2, to the inputs of an OR gate 215, the output of which is connected to the reset input of a counter by sixteen 216 which receives 1 Hz pulses on its clock input from the divider 2 of FIG. 2, whilst its output is connected to the second input of the gate 214. The output of the FF 210 is connected to the inputs of the gates 4, 33 and 43, formerly directly connected to the output of the amplifier 42, and also to the first input of an OR gate 217, the output of which is connected to the reset input of the counter 34, formerly directly connected to the output of the amplifier 42. The output of the FF 212 is connected to the second input of the gate 217, to the control inputs of the AND/OR selection gates 208 and 209, and also to the first inputs of the NAND gates 202 and 204, the second inputs of which are respectively connected to the outputs of the amplifiers 47 and 31 of FIG. 2. Apart from these few modifications, the circuit of FIG. 2 remains unchanged, and the explanations relating to this circuit remain valid. The functioning of the complementary circuit of FIG. 4 is explained as follows:

Normal functioning

The pull-out switch MH being pressed, the contact $C_{mh}$ is open and the output of the amplifier 42 is at 0. The shaping circuit 206 is off and the outputs of the FF 210 and 212 are at 0. The gates 4, 33 and 43 are blocked, The reset of the counter 34 is at 0. The AND/OR selection gates 208 and 209 respectively select on their outputs the information delivered by the minute counter 6 and by the hour counter 8. The working conditions are thus the same as in the circuit of FIG. 2 and one can display, in turn, the hours and minutes, the date, the month, the time zones and the seconds by actuating the push-button P1, and correct these parameters by actuating the push-button P2.

Time setting

To effect the time-setting it is first necessary to bring the counter 34 into position 3 (display of time zones) by means of the push-button P1. The output 3 of the counter 34 is then at 1 and the output of the inverter 211 at 0. When the pull-out switch MH is pulled the contact $C_{mh}$ closes and the output of the amplifier 42 passes to 1. The outputs of the FF 210 and the gate 217 pass to 1, whilst the output of the FF 212 remains at 0. The counter 34 is returned to 0, whilst the gates 4, 33 and 43 are unblocked. The AND/OR gates 208 and 209 still select on their outputs the information from the counter 6 and the counter 8. The same conditions are again found as during the hour setting in the circuit of FIG. 2. The hands come to position 0, then one can add hours by means of P1 and minutes by means of P2. At the moment when MH is pressed, the output of the amplifier 42 passes to 0 and the output of the amplifier 213 to 1. A positive pulse is transmitted to the terminals of $R_3$ by $C_3$. This pulse returns FF 210 to 0. The output of the gate 217 passes to 0, which makes the reset of the counter 34 free, the gates 4, 33 and 43 being blocked again. The circuit is then again in normal working conditions.

Interlocking and correction of the alarm time

The alarm may be switched on when the counter 34 is in any state whatsoever, except the state 3. Its output 3 is then at 0 and the output of the inverter 211 at 1. If one pulls the switch MH, the output of the amplifier 42 passes to 1, which makes the output of the FF 212 change over to state 1, the output of the FF 210 remaining at 0. The gates 4, 33 and 43 remain blocked, and the gates 202 and 204 are unblocked. The output of the gate 217 has passed to 1 which effects the reset of the counter 34, whilst the AND/OR gates 208 and 209 respectively select at their outputs the information delivered by the counters 201 and 203. Therefore, the hour hand will come to display the contents of the alarm hour counter 203 instead of that of the hour counter 8, and the minute hand will come to display the contents of the alarm minute counter 201 instead of that of the minute counter 6. Simultaneously, it is possible to correct the alarm hour by pressing P1, pulses passing from the output of the amplifier 31 to the clock input of the counter 203 via the gate 204, or to correct the alarm minute by pressing $P_2$, pulses passing from the output of the amplifier 47 to the clock input of the counter 201 via the gate 202.

On the other hand, the comparator 205 delivers a signal to the shaping circuit 206 when the contents of the counters 6 and 201 and 8 and 203 are simultaneously equal. The enable input of the shaping circuit being at 1, this will thus deliver acoustic alarm signals via the buzzer 207 when this condition occurs, that is to say when the programmed alarm time is attained.

It is obvious that the watch must not remain blocked in the alarm time display position, which would render it unserviceable for the display of other parameters as long as the alarm is switched on. At the moment when one pulls the switch MH the output of the amplifier 42 passes to 1 and the output of the inverter 213 to 0, as does the output of the gate 215. The reset of the counter by sixteen 216 thus passes to 0 and this counter starts to count. At the end of sixteen seconds, if it is not reset meanwhile, it delivers a positive signal at its output. The output of the gate 214 passes to 1 and resets the FF 212, which blocks again the gates 202 and 204, and AND-/OR gates 208 and 209 select again the information delivered by the counters 6 and 8. The hour and minute hands come to display again the contents of these counters, that is to say hours and minutes. The output of the gate 217 is returned to 0 liberating the counter 34.

We are now again in normal working conditions, that is to say that one can display on demand the date, the month etc. However, the pull-out switch MH has not been pressed and the output of the amplifier 42 is still at 1. Because of this, the shaping circuit 206 is still unblocked and the alarm will ring when the comparator 205 delivers an equality signal. To stop this signal, it suffices to push MH.

Thus the hour and the minute of alarm are only displayed momentarily, during a time determined by the counter 216 acting as a delay circuit. The correction of the hour and minute of alarm can only be made during the same time. However, so that the counter 216 does not interrupt the display of the alarm whilst one is engaged in making a correction, the outputs of the amplifiers 31 and 47 are connected to inputs of the gate 215, to reset the counter 216 at each manipulation of P1 or P2. By this fact, the duration of the alarm display is extended and comes to the end sixteen seconds after the last correcting manipulation.

If one again presses MH before the counter 216 has delivered a reset signal, the positive pulse appearing on $R_3$ makes the output of the gate 214 pass to 1 which resets the FF 212.

Summarizing:

MH pressed=normal functioning: display of hours and minutes, date, month etc. on demand.

MH pulled, counter 34 in position 0, 1, 2 or 4=switching on of alarm, momentary display of alarm time, and possible correction during the duration of this display using switches $P_1$ and $P_2$. Return to normal display and to normal functioning will occur at the end of a time lapse determined by a delay circuit, with the alarm remaining switched on.

MH pulled, counter 34 in position 3: reset of hour and minute hands, correction of hours and minutes.

It can be seen that it is thus easy, by adding several supplementary functions to the circuit of FIG. 2 to increase the possibilities of the watch without any modification of the mechanical part or of the control means.

It is of course obvious that the figures are given by way of example and that one can make the same functions by using more or fewer control contacts or by using other circuit configurations. For example, in a microprocessor organization, one would preferably use information in sequential form which would be transferred when needed into intermediate memories coupled to comparison circuits. These different organizations of circuitry do not however alter the principle of functioning of the watch.

What is claimed:

1. An electronic time piece comprising:

means for producing time base pulses;

means responsive to said time base pulses for producing a plurality of time signals;

a minute hand;

means coupled to said minute hand for producing a signal representative of the position of said minute hand;

means responsive to a first manual action for producing a first manual command;

means responsive to said first manual command for selecting one of said time signals;

means responsive to said selected one of said time signals and to said minute hand position signal for producing a first comparison signal whenever said one selected time signal is unequal to said minute hand position signal;

means responsive to said first comparison signal for producing driving pulses;

means responsive to said driving pulses for driving said minute hand, thereby causing said minute hand to be driven to a position corresponding to said one selected time signal in response to said first manual command.

2. The electronic time piece of claim 1, further comprising means for producing a plurality of time independent signals, said first manual command producing means being further responsive to a second manual action preceding said first manual action for producing a second manual command, said selecting means being further responsive to said second manual command for selecting one of said time independent signals, and said first comparison signal producing means being further responsive to said selected one of said time independent signals and said minute hand position signal for producing said first comparison signal, thereby causing said producing means to produce said driving pulses and said driving means to drive said minute hand to a position corresponding to said selected one of said time independent signals in response to said second manual command.

3. The electronic time piece of claim 1, further comprising means responsive to a third manual action for producing a correction command and means coupled to said selecting means and responsive to said correction command for setting said one selected time signal to a desired value.

4. The electronic time piece of claim 1, wherein said plurality of time signals producing means comprises minute signal producing means and hour signal producing means, further comprising an hour hand drivingly engaged with said minute hand, means coupled to said hour hand for producing a signal representative of the position of said hour hand, and means coupled to said selecting means and responsive to said hour signal and to said hour hand position signal for producing a second comparison signal whenever said selected one of said time signals is said minute signal and said hour signal is unequal to said hour hand position signal, said driving pulses producing means being further responsive to said second comparison signal for producing said driving pulses, thereby causing said driving means to further drive said hour hand to a position corresponding to said hour signal.

5. The electronic time piece of claim 1, wherein said minute hand position signal producing means comprises a first counter, and further comprising means coupled to said minute hand for resetting said first counter whenever said minute hand reaches a predetermined position.

6. The electronic time piece of claim 4, wherein said hour hand position signal producing means comprises a second counter, and further comprising means coupled to said hour hand for resetting said second counter whenever said hour hand reaches a predetermined position.

7. The electronic time piece of claim 3, wherein said plurality of time signals comprises at least a minute signal, and further comprising means for producing at least a minute alarm signal and means responsive to said minute alarm signal and to said minute signals for producing an alarm output signal when said minute signal equals said minute alarm signal, said selecting means being coupled to said minute alarm signal producing means and operable to select said minute alarm signal in response to said first manual command, thereby causing said minute hand to be driven to a position corresponding to said selected minute alarm signal in response to said first manual command and enabling said minute alarm signal producing means to be set to a desired value in response to said manual time correction command.

* * * * *